US005251957A

United States Patent [19]

Lemens

[11] Patent Number: 5,251,957

[45] Date of Patent: Oct. 12, 1993

[54] POSTURE SUPPORT DEVICE

[75] Inventor: Thomas G. Lemens, Briarcliff Mansion, N.Y.

[73] Assignee: Planar Support Systems, Inc., Katonah, N.Y.

[21] Appl. No.: 845,895

[22] Filed: Mar. 4, 1992

[51] Int. Cl.[5] ..... A47C 7/02

[52] U.S. Cl. ..... 297/230.1; 297/284.7

[58] Field of Search ..... 297/231, 283, 284.1, 297/284.2, 284.3, 284.4, 284.5, 284.7, 284.11

[56] References Cited

U.S. PATENT DOCUMENTS

| | | | |
|---|---|---|---|
| 2,734,556 | 2/1956 | Hebrank | 297/284.7 X |
| 3,265,437 | 8/1966 | Mincieli | 297/231 X |
| 3,279,849 | 10/1966 | Radke et al. | 297/284.7 X |
| 3,495,871 | 2/1970 | Resag et al. | 297/284.5 X |
| 3,813,148 | 5/1974 | Kraus | 297/231 |
| 4,810,034 | 3/1989 | Beier | 297/231 X |
| 4,824,169 | 4/1989 | Jarrell | 297/284.5 |
| 4,865,380 | 9/1989 | Heitzman-Powell et al. | 297/231 X |

FOREIGN PATENT DOCUMENTS

| | | | |
|---|---|---|---|
| 2856366 | 2/1980 | Fed. Rep. of Germany | 297/284.5 |

*Primary Examiner*—Laurie K. Cranmer

*Attorney, Agent, or Firm*—Sprung Horn Kramer & Woods

[57] ABSTRACT

A posture support device comprising a longitudinally extending rigid planar back support member.

8 Claims, 4 Drawing Sheets

POSTURE SUPPORT DEVICE

The design of back rests to supplement the support provided by ordinary seating, such as for example in offices, homes, automobiles airplanes and other seating environments, has been the subject of a great deal of research and development. The object of this research and development has been to provide means for alleviating the back pain and discomfort that is experienced by many people after extended periods of time in a seated position. For example, such discomfort commonly occurs during the course of lengthy trips in automobiles and airplanes and during lengthy periods of sitting at a computer or word processor.

There are many different designs of back rests available for use in conjunction with chairs or seats to help alleviate the pain and discomfort associated with extended periods of time in the seated position.

U.S. Pat. No. 2,734,556 describes a backrest having an adjustable rest pad to provide pressure against the small of the user's back, so that the back will be supported, and discomfort relieved or avoided. This tends to promote improper posture, however, by making poor posture bearable, and does not address the problem of improper posture itself.

U.S. Pat. No. 4,516,568 describes a seat back which is said to exert a preselected amount of pressure in a uniform manner throughout a preselected area of the surface of the body. This seat back also, however, does not address the problem of improper posture.

U.S. Pat. No. 4,718,724 describes an adjustable lumbar support device which, like the other prior art devices, is said to alleviate the discomfort resulting from incorrect posture, without regard to correcting the incorrect posture itself.

U.S. Pat. No. 4,887,865 provides an orthopedic seat and backrest combination which is adjustable in accordance with individual comfort requirements, but, like the previously mentioned devices, does not address the problem of improper posture.

Many of the difficulties sought to be treated by the prior art devices are caused by improper posture and the prior art devices merely make improper posture comfortable, thereby perpetuating, rather than correcting, the improper posture. In fact, many of these devices even aggravate or exaggerate posture problems by over-correcting problems in some instances and/or by the device itself actually pushing the spine out of proper alignment.

In accordance with the teachings of Alexander (*The Alexander Technique*, by Wilfred Barlow (Healing Arts Press, 1990)), correct posture requires a general linear alignment of the head, neck and torso, which can be illustrated when standing as defining an imaginary "plumb line" from the mastoid process through the center line of the torso, the trochanter of the thighbone, and slightly behind the malleolus of the ankle. With such an alignment of the body, the correct curvature of the spine takes place and excessive muscle tension in the neck and lower back will be relieved and the associated discomfort will be relieved or avoided.

The required correct posture is defined by the body being essentially aligned with the force of gravity. This line of force can be, in turn, described within three dimensional space by a plane. Postural difficulties and the associated pain and discomfort mentioned above generally result from deviation of the body away from that line or plane.

It is therefore an object of this invention to provide both support and a sensory guide to lead individuals from the afore-described state of dysfunction to a more accurate usage of the body.

This and other objectives are met in accordance with the present invention, whereby there is now provided a longitudinally extending rigid planar back support device. In one particular embodiment of the longitudinally extending rigid planar back support device of this invention, said support device includes a back support member and a bolster pad which can be used to adjust the angular relationship of said back support member with respect to a chair back or other substrate upon which it may be mounted. Means may also be provided, in accordance with the invention for mounting said bolster pad on the rear and transversely to said back support member, and may further include means for adjusting the longitudinal location of said bolster pad relative to said back support member.

I have discovered that, by using a plane surface as a sensory guide, individuals can best be helped to establish their own correctly aligned body posture with the resultant proper spinal curvature.

By contrast, the heretofore known backrests generally incorporate a lumbar support and a backward incline, thought to promote the comfort of the person using the backrest, which tends to take the person out of the plane of gravity and rounds the lumbar spine in the opposite direction than is usually caused by most sitting situations. That is going from a forward bending lumbar posture to a backward bending posture. These supports do not facilitate appropriate body or spinal posture, and while they allow some relief for lumbar discomfort, they give decreased support for the thoracic and cervical spine and often shift problems to these areas.

Through the use of the planar support device I have now discovered, however, the body is aligned and the spinal column is actually lengthened, and the natural forces of erector spinae muscles create suitable spaces between the supporting planar surface and spine, thereby promoting correct posture. For example, as the back of the sacral spine curves slightly forward, a resting point is formed against the plane. The lumbar curve then comes delicately away from the planar support; the thoracic curve returns to the plane of support; the neck curves away.

Such a planar support device, in addition to promoting correct posture, helps remove compression from the vertebrae and intervertebral discs, and the normal loss of circulation that accompanies compressed vertebrae and intervertebral discs is minimized. Compression or pinching of the nerve pathways is also thereby reduced.

In a particularly preferred embodiment, the back support device of this invention also includes a seat support member and may optionally include means for securing said seat member to the back support member. In an especially preferred embodiment, said seat member is removably mounted to said back support device, so that the back support member may be utilized either with or without said seat member.

The seat provides a basis of support which does not allow the body mass to sink downward and limits forward lumbar curvature. The seat member, along with the back support member of the system, supports proper pelvic tilt thereby providing for proper spinal curvature and aligned upright posture.

An additional important function provided by the seat support member to the overall back support system is that it helps the user find the ischial tuberosities which are the foundations of the pelvis and spine and assists the back support member of the system support the body in an erect posture.

In a further embodiment, the back support device of the invention may optionally include a head support member, and means for securing said head support member to said back support member, which means may optionally be permanent or removable.

DETAILED DESCRIPTION OF THE DRAWINGS

Figure 1:
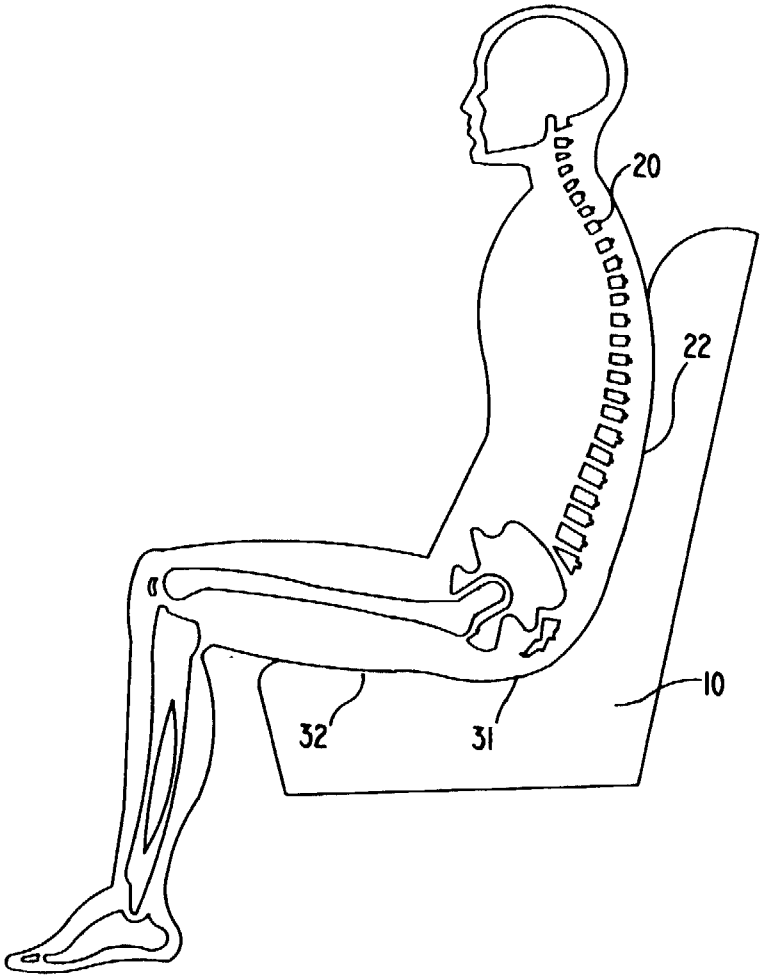
FIG. 1 depicts a person seated in a typical automobile seat in a position which is dysfunctional.

In FIG. 1 there is illustrated a person seated in an automobile seat (10) without the aid of the planar posture support device of this invention. The spinal column is curved forward in a dysfunctional "C" shape. The back is dysfunctionally supported in the lumbar region (22) rather than in the preferred locations in the rib cage and the back of the pelvis (46 and 45, FIG. 3). The pelvis is dysfunctionally supported on the coccyx (31) and the soft tissues of the hamstring muscles (32) rather than being supported in the preferred manner under the ischial tuberosities or sitting bones (33, FIGS. 2 and 3). Such dysfunctional spinal curvature conditions the user towards the incorrect posture and can ultimately result in backache, neckache, disc disease, and other back related problems.

Figure 2:
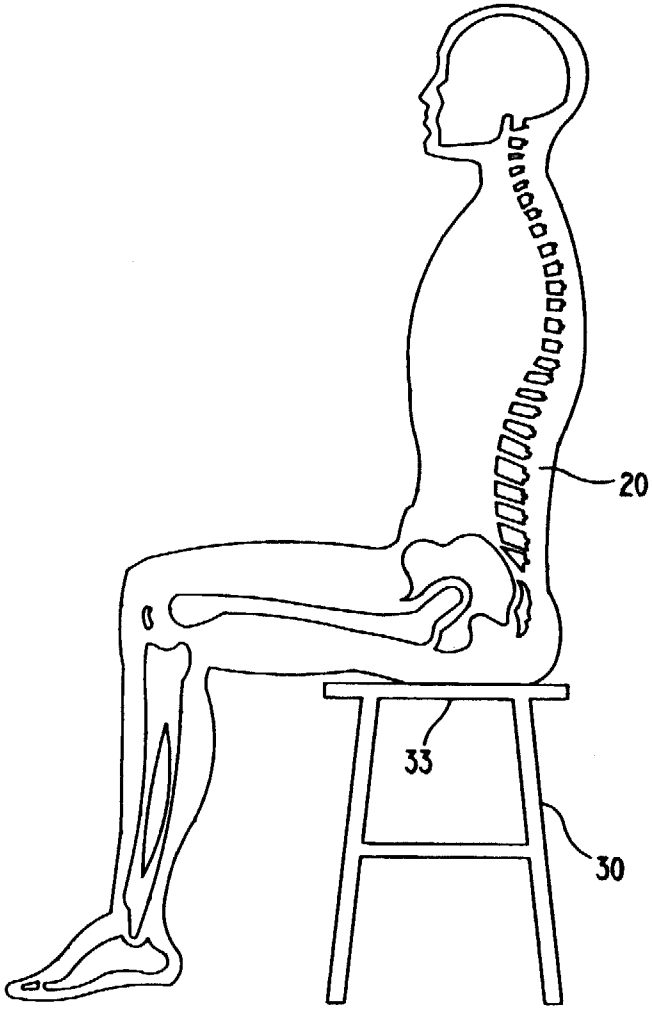
FIG. 2 depicts a person seated in an optimal position with respect to the body and the spinal column.

In FIG. 2 there is illustrated a person in a seated position in which the spinal column (20) is aligned in a correct posture position. The alignment of the spinal curves is such as to support the body in alignment with the forces of gravity. The body is supported through the seat at the ischial tuberosities (33). Therefore, the spine is supported naturally maintaining its intrinsic curvature (20). The body is conditioned toward correct posture, and backache, neckache, and similiar problems are less likely to occur.

Figure 3:
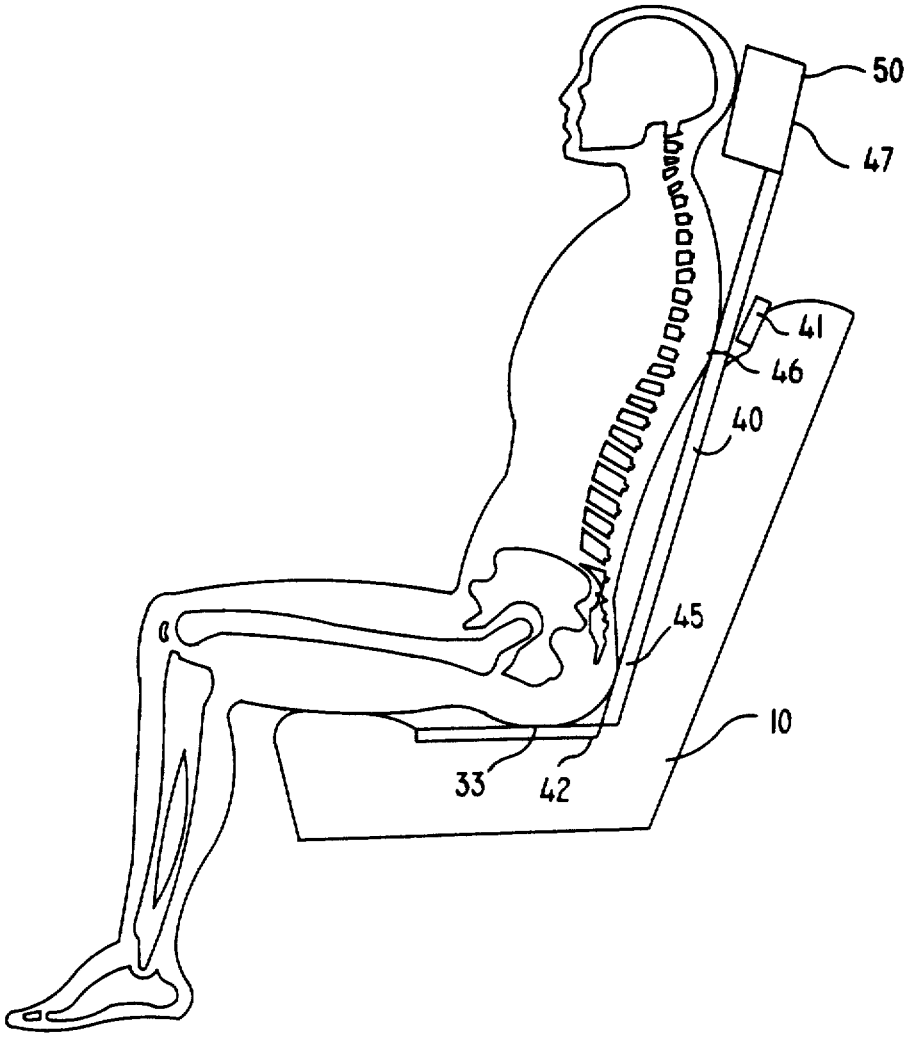
FIG. 3 depicts a person seated on a planar support device of this invention.

In FIG. 3 there is illustrated a person seated in an automobile seat (10) which has been equipped with the planar posture support device of the present invention comprising back support member (40) with optional bolster pad (41), seat support (42) and headrest (50). Here the body is supported nearly parallel to the forces of gravity with the spinal curves demonstrating good posture. The pressure from said rigid planar back support member (40) in conjunction with the firm foundation provided by said seat member (42) gives the user corrective postural feedback which is lacking in normal seating and prior art corrective seating. Initial feedback comes from pressure against the rib cage and the back of the pelvis from said planar back support (40). Feedback pressure from said back support member indicates to the user whether the user is making appropriate (45) and (46) or inappropriate (22, FIG. 1) contact with said support. Appropriate contact is here defined as the tangential contact of the back support with the midpoint of intrinsically forward curving portions of the user's back (45) and (46) [and the user's head in the head support model (47)], whereas, inappropriate contact (22, FIG. 1) is defined as pressure against surfaces other than those surfaces defined above, as for example against those surfaces of the back which intrinsically curve backwards and therefore should be distanced from a planar supporting surface. Secondary feedback comes from the sense of downward pelvic pressure against said seat member (42) which indicates the amount of force through the pelvis and the spine and indicates a sense of proper or improper pelvic tilt. Proper pelvic tilt is indicated by the sense of pressure against and through the ischial tuberosities which are also known as sitting bones (33). Improper or dysfunctional pelvic tilt is indicated by pressure against and through the coccyx or tail bones (31, FIG. 1) and pressure against the soft tissues of the hamstring muscle group (32, FIG. 1).

Figure 4:
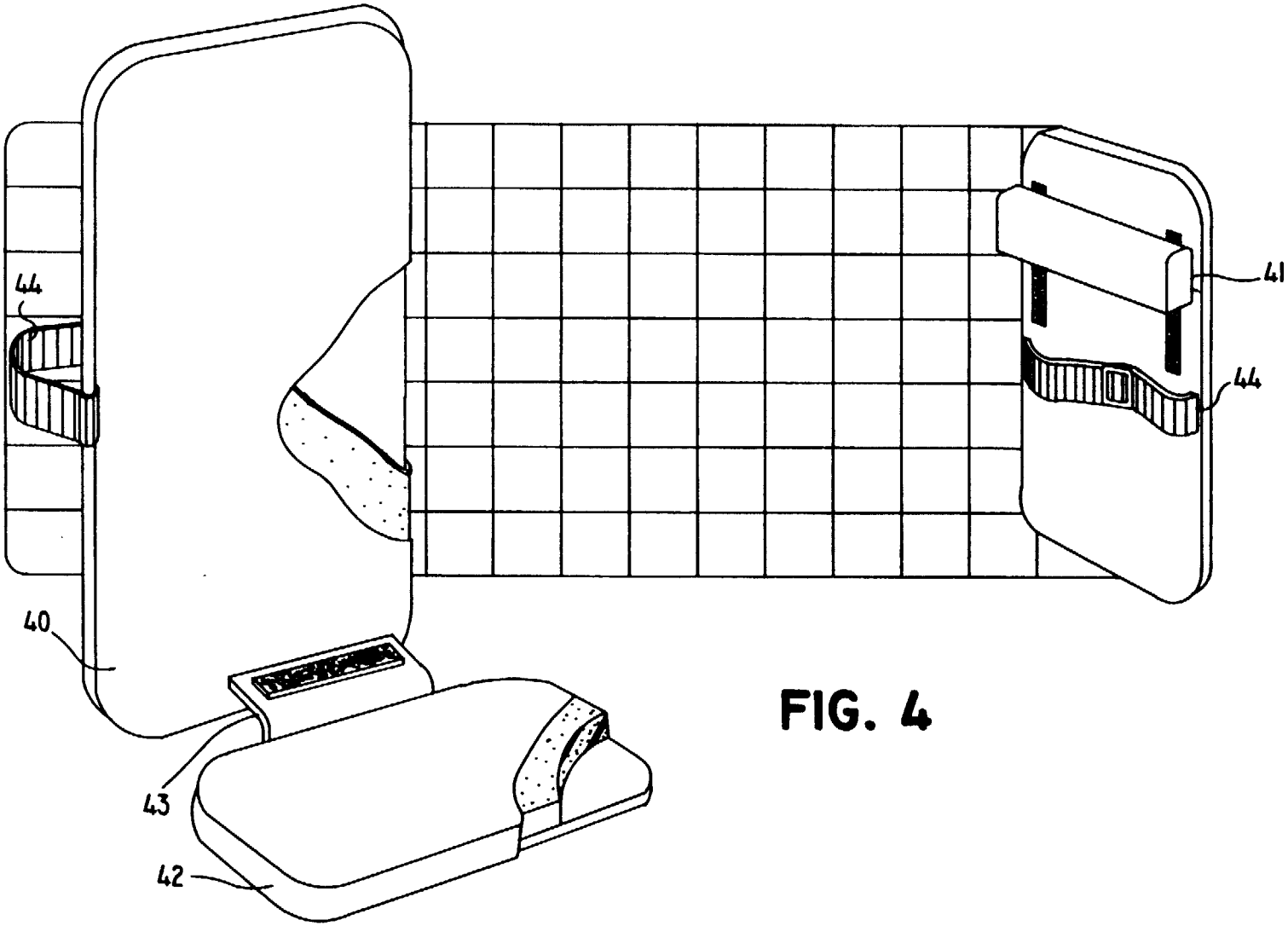
FIG. 4 is a frontal and rear view of back support member (40) with optional bolster pad (41) mounted thereon and the optional seat member (42).

In FIG. 4 there is illustrated the planar support device (40) of the invention, with optional mounting straps (44) for securing the support device to a substrate, such as an automobile seat, optional bolster pillow (41) and optional seat support (42) removably attached by attachment means (43). The back support member comprises a flat planar surface against which the back of a human may be rested so as to provide planar support and promote proper alignment of the spinal column. This device may include a limited amount of front padding, provided, however, that the padding is not in such an amount as would deflect the spinal alignment from the plane provided by the planar posture support device.

Figure 5:
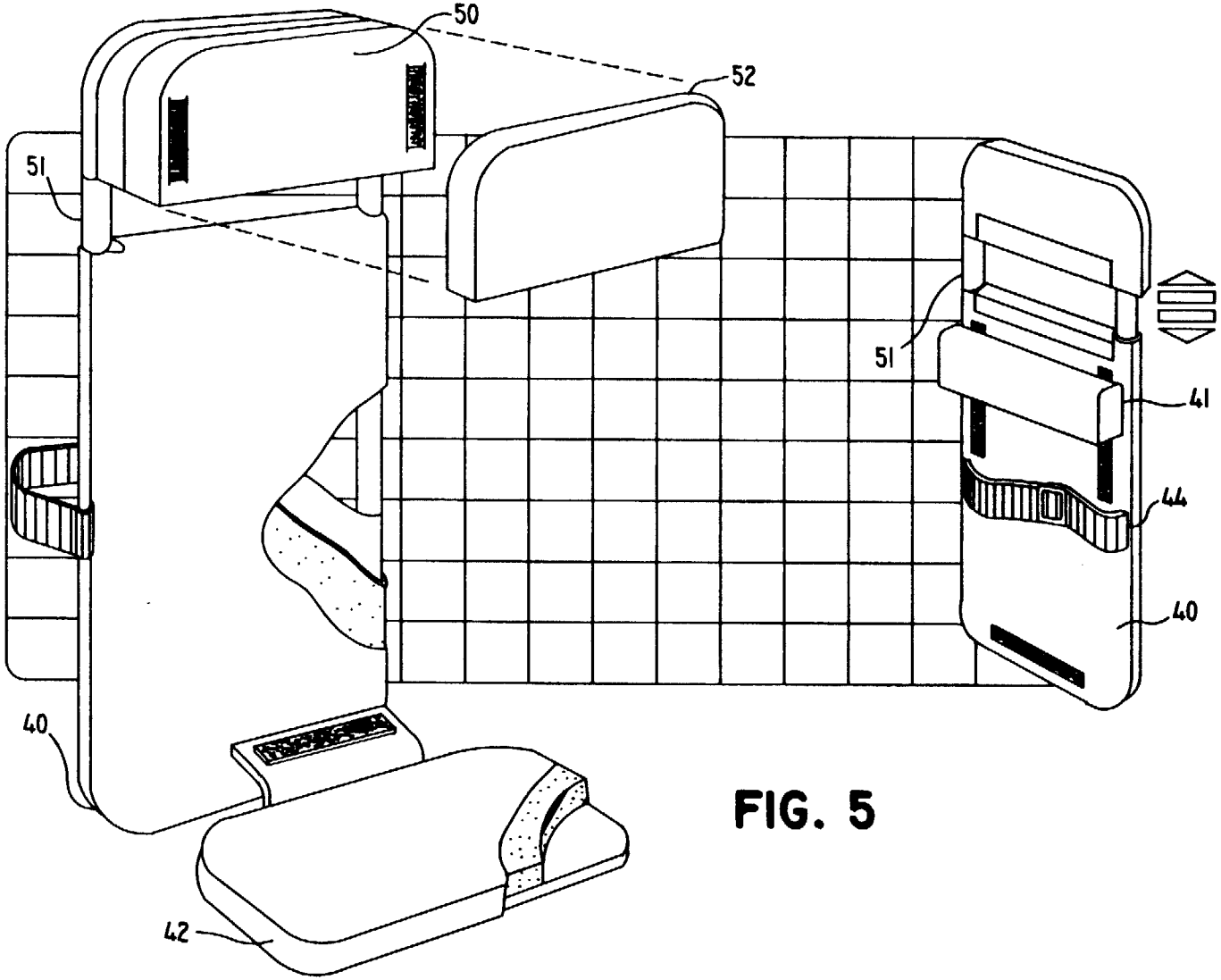
FIG. 5 is a frontal and rear view of the planar posture support device (40) with optional seat support (42) and optional headrest (50).

In FIG. 5 there is illustrated the planar posture support device of this invention, comprising back support member (40) with optional headrest (50), a means (51) for removably and adjustably mounting the headrest (50) to the support device (40). Headrest (50) is optionally designed with individual expansion sections (52), so that the thickness of the headrest may be adjusted by adding or removing sections so that the head would be supported in correct alignment with the neck and torso.

The planar support device of the present invention may be constructed of various materials known to those skilled in the art such as, for example, wood, metal or plastic, or a combination thereof. The devices may be covered or uncovered, and when covered, can be covered with leather, plastic, cloth or the like.

The various embodiments which have been set forth above are for illustration and are not intended to limit the invention. It will be appreciated by those skilled in the art that various changes and modifications may be made to the embodiments described in the specification without departing from the spirit and scope of the invention as defined by the appended claims.

What is claimed is:

1. A posture support device comprising a longitudinally extending rigid planar back support member;

a bolster pad which in use is positioned between said back support member and a substrate upon which the posture support device is rested;

means for mounting said bolster pad on the rear and transversely of said back support member, and means for adjusting the longitudinal location of said bolster paid relative to said back support member.

2. A method for supporting and aligning the back of a human while in a seated position which comprises resting the back of said human against a posture support device comprising a longitudinally extending rigid planar back support member;

a bolster pad which in use is positioned between said back support member and a substrate upon which the posture support device is rested;

means for mounting said bolster pad on the rear and transversely of said back support member, and means for adjusting the longitudinal location of said bolster pad relative to said back support member.

3. A portable postural support system for a human body that provides a guide for the spine and utilizes the body's natural structural resources for support and planar alignment when the body is seated on a seat having a seatback, comprising:

a longitudinally extending rigid planar back support member having a lower end portion for engaging the seat and a front side for engagement with the back portion of the upper torso of a human body; and bolster pad means positioned on a back side of said back support member for maintaining a space between the seatback and the back side of said planar back, and means for adjusting the longitudinal location of said bolster pad means relative to said back support member.

4. The postural support system of claim 3 and further including a seat support member and connecting means for releasably connecting said seat support to said back support member at the lower end thereof so as to permit convenient attachment and detachment with said back support member.

5. The postural support system of claim 4 wherein said connecting means is a VELCRO strip on each of said back and seat support members.

6. The postural support system of claim 3 wherein said bolster pad means is conveniently adjustable at a plurality of longitudinal positions to selectively vary the angular relationship between said back support member and said seat.

7. The postural support system of claim 6 and further including a seat support member and connecting means for providing a quickly detachable connection between said seat support member and said back support member.

8. The postural support system of claim 7 and wherein said connecting means is comprised of VELCRO closure on each of said seat and back support members.

* * * * *

UNITED STATES PATENT AND TRADEMARK OFFICE

CERTIFICATE OF CORRECTION

PATENT NO. : 5,251,957

DATED : October 12, 1993

INVENTOR(S) : Thomas G. Lemens

It is certified that error appears in the above-indentified patent and that said Letters Patent is hereby corrected as shown below:

Col. 6, line 4 After " 3 " delete " and "

Signed and Sealed this

Fourteenth Day of March, 1995

*Attest:*

*Attesting Officer*

Bruce Lehman

BRUCE LEHMAN

*Commissioner of Patents and Trademarks*